United States Patent [19]

Prouse et al.

[11] 4,104,115

[45] Aug. 1, 1978

[54] METHOD OF MAKING PAPER FROM WATER INSOLUBLE ALGINATE FIBERS AND THE PAPER PRODUCED

[75] Inventors: Ronald Ernest Prouse, Upminster; Anthony Alfred West, Basildon; Derek Anthony King, South Woodham Ferrers; Roger Poulson, Billericay, all of England

[73] Assignee: Carreras Rothmans, Limited, England

[21] Appl. No.: 775,621

[22] Filed: Mar. 8, 1977

Related U.S. Application Data

[63] Continuation of Ser. No. 420,052, Nov. 29, 1973, abandoned, which is a continuation-in-part of Ser. No. 231,837, Mar. 2, 1972, abandoned.

[51] Int. Cl.[2] ..... D21H 5/12

[52] U.S. Cl. ..... 162/100; 162/111; 162/157 R; 162/158

[58] Field of Search ..... 162/157 R, 162, 175, 162/198, 111, 158, 100; 264/186

[56] References Cited

U.S. PATENT DOCUMENTS

| | | | |
|---|---|---|---|
| 1,957,913 | 5/1934 | Smith | 162/111 |
| 2,371,717 | 3/1945 | Speakman | 264/186 |
| 2,423,075 | 6/1947 | Hall | 264/186 |
| 2,600,504 | 6/1952 | Johnson et al. | 162/157 R |
| 2,648,635 | 8/1953 | Brown et al. | 162/157 R |

FOREIGN PATENT DOCUMENTS 672,896 5/1952 United Kingdom.

*Primary Examiner*—S. Leon Bashore
*Assistant Examiner*—William F. Smith
*Attorney, Agent, or Firm*—Roylance, Abrams, Berdo & Farley

[57] ABSTRACT

A method of manufacturing calcium alginate sheets, without the use of an adhesive binder, by use of a Fourdrinier paper making machine is disclosed. Alginate material in fibrous form is obtained by squirting an aqueous solution of water-soluble alginate via a spinneret into a bath of an inorganic salt, whose cation will react with the alginate to produce a water-insoluble alginate. This fibrous alginate material is then fed into a Fourdrinier machine and formed into a sheet, and the pH value of the fibrous alginate slurry at the screen wire of the machine is at or below 7.0.

18 Claims, 1 Drawing Figure

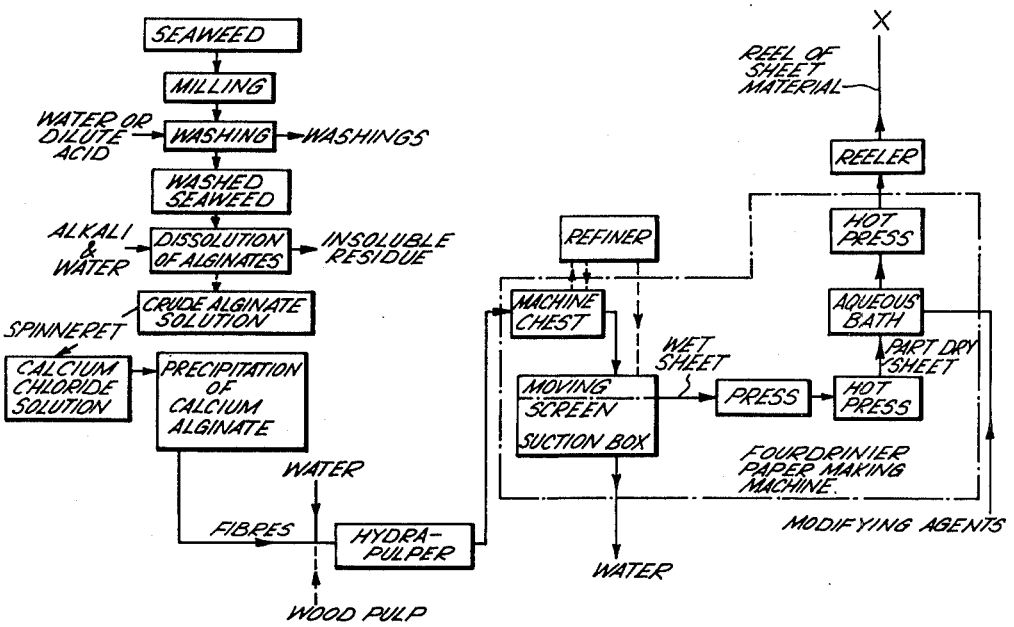

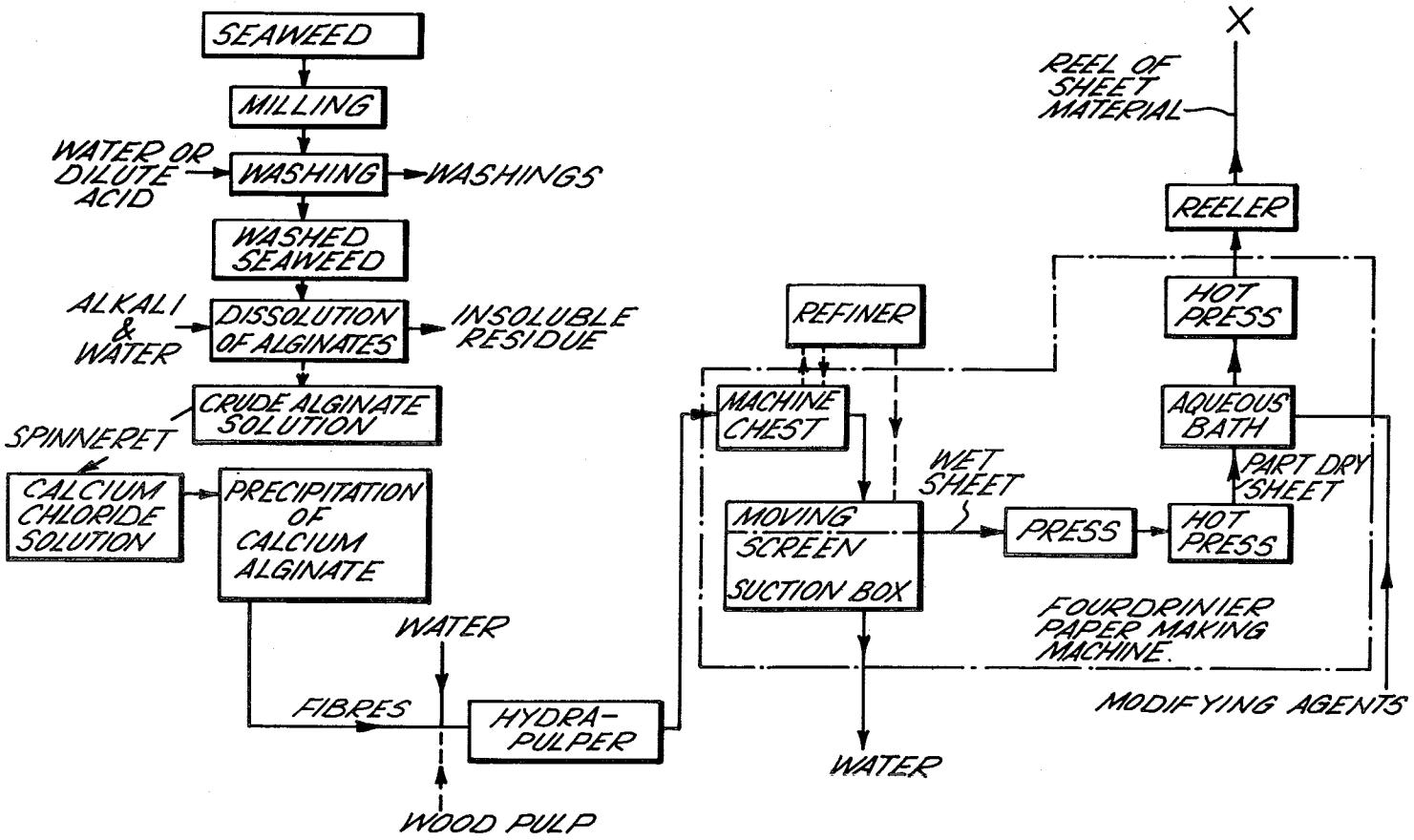
SEAWEED
MILLING
WASHING
WASHINGS
WATER OR DILUTE ACID
WASHED SEAWEED
DISSOLUTION OF ALGINATES
INSOLUBLE RESIDUE
ALKALI & WATER
CRUDE ALGINATE SOLUTION
SPINNERET
PRECIPITATION OF CALCIUM ALGINATE
CALCIUM CHLORIDE SOLUTION
WATER
FIBRES
HYDRA-PULPER
WOOD PULP
REFINER
MACHINE CHEST
MOVING SCREEN
SUCTION BOX
WET SHEET
PRESS
WATER
HOT PRESS
AQUEOUS BATH
PART DRY SHEET
HOT PRESS
FOURDRINIER PAPER MAKING MACHINE
MODIFYING AGENTS
REELER
REEL OF SHEET MATERIAL
X

METHOD OF MAKING PAPER FROM WATER INSOLUBLE ALGINATE FIBERS AND THE PAPER PRODUCED

This application is a continuation of application Ser. No. 420,052, filed Nov. 29, 1973, abandoned; which application was a continuation-in-part of application Ser. No. 231,837, filed Mar. 2, 1972, abandoned.

This invention relates to the manufacture of alginate sheet material from alginate fibre and relates particularly, but not exclusively, to the manufacture of calcium Alginate sheet material from calcium alginate fibre. This invention also relates to alginate sheet made by the process.

It has hitherto been considered necessary in the manufacture of calcium alginate sheet from calcium alginate fibre or filaments to use in the stock presented to the screen (wire) of the paper-making machine an adhesive, for example gelatine, hide glue or carboxymethyl cellulose, or a swelling agent such as sodium carbonate to form a water soluble alginate. This conception has probably arisen from statements made to this effect in the specifications of U.K. Pat. No. 626,518 and to corresponding U.S. Pat. No. 2,600,504 and in U.K. Pat. No. 632,050.

What seems, in retrospect to have happened is that the above patentees either took in all cases as a starting material, waste calcium alginate material from the textile industry and tried to make a paper from it without the use of a binder or swelling agent or quoted other sources, who had taken a starting material consisting of such waste material and so tried.

As a result of these failures with waste calcium alginate material from the textile industry it was concluded that the calcium alginate was at fault and that in general calcium alginate fibres could not be made into a satisfactory paper without the use of a swelling agent or adhesive binder.

When the inventors became concerned with this problem this had become the generally accepted view of the experts.

Completely against the trend of opinion of the experts and patent literature, the present inventors have surprisingly discovered that alginate material in raw fibrous form, (for example as obtained from mixing an aqueous solution of water-soluble alginate with an inorganic salt solution, whose cation will react with the alginate to produce a water-insoluble alginate, can be formed into a sheet on a papermaking machine with the pH value of the fibrous alginate slurry at the screen (wire) of the machine being at or below pH 7.0 and without necessary use of an additional adhesive binder or swelling agent.

No certain explanation exists for the contradiction between the prior art and the present invention but the most likely correct explanation seems that on the one hand it is true that the waste alginate products of the textile industry cannot be made into a satisfactory paper without first treating them with a swelling agent or using an adhesive binder and the inventors have confirmed this for a sample of calcium alginate textile waste yarn but on the other hand the assumption that this applies to calcium alginate in general is false as shown by the success of the present inventors.

Calcium alginate is commercially available from seaweed and if taken at the so-called precipitation stage is unexpectedly suitable for use in the process. The precipitation stage is that reached after (i) milling wet or dry seaweed, (ii) washing the milled material with water or a dilute acid, and (iii) treating the washed seaweed with alkali and water to form a crude alginate solution, and (iv) squirting the solution through, for example a spinneret into an aqueous Calcium chloride solution to thereby precipitate the calcium alginate in the desired fibrous form.

It is possible to recycle the calcium alginate through back to stage 3 above where it is treated with alkali and water to reform an alginate solution which then proceeds to stage 4.

Where the textile waste alginate material can be returned to its raw form, i.e. free of contamination or modification by materials used in the textile industry and free of Sodium alginate or other adhesive binder such reclaimed material can be used and is included in the term "raw" as used herein. However, at the present time there is relatively little waste alginate material available from the textile industry and so this reclaim aspect is at present of far less importance as compared with the use of virgin raw alginate material.

Reference will now be made by way of example to the accompanying diagramatic single FIGURE flow sheet, which illustrates an outline one convenient embodiment of the method according to the present invention.

Referring not to the diagram, calcium alginate fibre is produced by the squirting of crude alginate solution for example via a spinneret (nozzle) into calcium chloride solution to precipitate calcium alginate in the fibrous form directly suitable for manufacture into sheet material (paper) on a paper making machine by the process of the invention.

The crude alginate solution (for example sodium alginate) may be obtained, for example, from seaweed by the commercially known process as shown in the first stages of the left-hand side of the flow sheet. Alginic acid could be manufactured synthetically, however, thus eliminating the need to rely on seaweed as the starting material, and converted to sodium alginate solution which would then again be fed into the calcium chloride solution via the spinneret (nozzle).

The Fourdrinier paper making machine essentially includes a continuously moving screen (wire) conveniently moving over a suction box to remove water not already removed by simple drainage. In the arrangement shown in the flow sheet, the wet paper (sheet) so formed is then passed through a cold press and thereafter to the first so-called hot press, which contains heated drying cylinders, and thence via the aqueous bath (also known as a size press) to the second so-called hot press, containing further heated drying cylinders.

EXAMPLE

35 Kg of moist calcium alginate raw fibre material (grade "CA-33" ex. Alginate Industries Ltd, a United Kingdom company) at approximately 40% dry material content) was charged to a pulp beater with sufficient water to give a 6% consistency. A steam jacket of the hydrapulper was used to produce and maintain a pulp temperature of 35° C. The charge was beaten for 15 mins. to a freeness of 15° Schopper-Riegler, and then 360 gms. paper makers alum (aluminium sulphate) was added as pH control agent to give a pH of 6.5. Beating was continued for a further 25 minutes to a freeness of 24° Schopper-Riegler, and the stock transferred to the machine chest where it was diluted to 2% consistency.

This stock was run via the dilution box onto a pilot scale 'Fourdrinier' paper machine, bypassing the refiner, set to conditions described below. Processing was extremely easy, typical in-process readings as given below being obtained. The product was a yellow-brown coherent sheet of excellent quality, at ca. 100 g.s.m. dry weight. There was a shrinkage of ca. 18% through the machine.

Machine Settings (1) Flow to wire: 22 liters per minute.
(2) Machine speed: 20 ft/minute linear wire speed.
(3) Shake stroke amplitude: 3/16 inches.
(4) Felt tensions: all at 400 p.s.i.
(5) Nip pressures: all at 600 p.s.i.
(6) Drying cylinder steam pressures and recorded consequent temperatures during running were as follows:

| | First Hot Press | | | | | Second Hot Press | | | |
|---|---|---|---|---|---|---|---|---|---|
| Drying Cylinder No: | 1 | 2 | 3 | 4 | 5 | 6 | 7 | 8 | |
| Steam pressure (p.s.i.) | (variable) | 3 | 2 | 2 | 8 | off | 0 | 0 | 0 |
| Approx. Cylinder Temperature (° C) | 48 | 88 | 90 | 92 | 100 | off | 65 | 55 | 70 |

(No. 6 cylinder was not working during the run, but this did not affect the processing).

With the machine settings as above, the following were typical readings obtained at various points throughout the process during running:

(1) White water: 40 liters per minute.
(2) 1st Box vacuum: 4 inches mercury.
(3) 2nd Box vacuum: 4 inches mercury.
(4) 3rd Box vacuum: 3.5 inches mercury.
(5) Kopp: 16.
(6) Couch vacuum: 4 inches mercury.

The process is a continuous one and the alginate sheet material (paper) formed is wound by a reeler into a roll.

The terminology used in the above example to describe the conditions under which the paper making machine was operated is that in itself well known and used in the paper making art.

The sheet may be impregnated after the screen with any suitable material, for example, a surface active agent(s) conveniently to enhance its cleaning power, colour(s), aroma producing compound(s), conveniently at the aqueous bath (size press) stage. This is shown diagramatically by the use of the broad term modifying agents in the flow sheet. The aqueous bath (size press) will contain water or some other suitable solvent or an emulsion as the carrying agent for the material(s) to be incorporated in the sheet.

The surface active agent so added many conveniently comprise:

(1) An alkali salt of a long chain fatty acid, i.e. one preferably having 12 or more carbon atoms in its chain, for example, sodium laurate, stearate or sodium oleate.
(2) The reaction product of an organic amino compound with a fatty acid, for example, triethanolamine palmitate.
(3) A sulphonated or sulphated organic compound or an inorganic derivative thereof, for example, dioctylsodium-sulphosuccinate or dodecylbenzenesulphonate or sodium lauryl sulphate.
(4) A cationic surface active agent, for example, laurye, cetyldimethylbenzyl ammonium chloride.
(5) A non-ionic surface active agent, for example, polyoxyethylene glycol.

Colouring material may conveniently be added to the material of the sheet at any stage, such as for example, conveniently at the aqueous bath, and the colouring materials are conveniently water-soluble F.D.C.-approved colours.

Aroma producing materials may conveniently be added to the material of the sheet at any stage to produce, for example, a pine or fresh air aroma for example, terpineol or terpinolene.

A solid diluent or filler, for example, wood pulp, may be incorporated in the sheet, preferably in minor proportions and preferably as indicated in the flow sheet at the pulping stage. In one convenient example 5% sulphite wood pump was added and the pH at the screen (wire) of the paper making machine controlled at 6.85.

The sheet may at any suitable stage be crimped, creped or embossed.

The sheet may be shredded and used commercially in a mixture with other non-alginate shredded material.

In view of the prior art referred to above we had a sample of the raw calcium alginate fibre material (grade CA33 ex Alginate Industries Limited) analysed to determine if any sodium alginate or other adhesive material was present which could account for the success of the papermaking operation. According to the present invention this analysis was carried out by the Research Division of Rothmans International Limited (formerly called Carreras Limited) at Nevendon Road, Basildon, Essex, England and also at the Yarsley Research Laboratory at The Street, Ashtead, Surrey, England.

The results of this analysis, in which standard techniques were used is set out in the following table of analytical results in which the work of the Rothmans International Limited Research Division are referred to as C.R. Labs. and the work of the Yarsley Research Laboratory is referred to as Y.R.L.

TABLE OF ANALYTICAL RESULTS

| | | "CA33" FIBRES-AS SUPPLIED | | | PAPER MADE FROM AS SUPPLIED "CA33" FIBRES | | |
|---|---|---|---|---|---|---|---|
| COMPONENT | TECHNIQUE | Analytical Results found by C.R. Labs | Analytical Results found by Y.R.L. | Mean Figure | Analytical Results found by C.R. Labs | Analytical Results found by Y.R.L. | Mean Figure |
| Moisture | Drying for 24 hrs. at 110° C | 64.8%; 65.2% | 64.9%; 65.8% | 65.17% | — | 76.5%; 76.5% ** | 76.5% |
| Water Extractable | Aqueous Extraction/ | 0.37% | — | 0.37% | 0.02% | — | 0.02% |

-continued

TABLE OF ANALYTICAL RESULTS

| COMPONENT | TECHNIQUE | "CA33" FIBRES-AS SUPPLIED Analytical Results found by C.R. Labs | "CA33" FIBRES-AS SUPPLIED Analytical Results found by Y.R.L. | "CA33" FIBRES-AS SUPPLIED Mean Figure | PAPER MADE FROM AS SUPPLIED "CA33" FIBRES Analytical Results found by C.R. Labs | PAPER MADE FROM AS SUPPLIED "CA33" FIBRES Analytical Results found by Y.R.L. | PAPER MADE FROM AS SUPPLIED "CA33" FIBRES Mean Figure |
|---|---|---|---|---|---|---|---|
| Sodium | Flame Emission Spectroscopy | (mean of two determinations) | | | (mean of two determinations) | | |
| Total Sodium | Ashing/Acid Extraction/ Flame Emission Spectroscopy | 0.54% (mean of two determinations) | 0.68%; 0.68% | 0.63% | 0.06% (mean of two determinations) | 0.02%; 0.02% | 0.03% |
| Water Extractable Sodium | Aqueous Extraction/ E.D.T.A. Titration | 0.015% (mean of two determinations) | — | 0.015% | 0.003% (mean of two determinations) | — | 0.003% |
| Total Calcium | Ashing/Acid Extraction/ E.D.T.A. Titration | 9.10%; 9.48% | 9.3%; 9.4% | 9.32% | — | — | — |
| Water Extractable Chlorine | Silver Nitrate /Ammonium Thiocyanate Titration | 0.57% (Mean of two determinations) | 0.67%; 0.67% | 0.63% | 0.57%* (mean of two determinations) | — | 0.57% |

NOTES:

All Analytical Results are expressed as a percentage of the dry material in the sample (non-volatile in the standard conditions used), except the moisture results which are expressed as the percentage of the total, moist sample.

*These results approach the lower limit of detection of the technique used.

**These higher moisture results are due to the papers having been stored in a wet condition after paper manufacture.

CONCLUSIONS FROM ANALYSIS

From this analysis, CA33 sample assayed comprises, on a fair average:

| | | |
|---|---|---|
| Moisture | 65% | |
| $Cl^-$ (soluble) | 0.6% | on dry wt. |
| $Ca^{2+}$ total: | 9.29%) | (Theory Ca, Alg = 9.5% |
| soluble: | 0.015%) | on dry wt. |
| $Na^+$ total: | 0.63%) | |
| soluble: | 0.37%) | on dry wt. |

On this basis, we infer that:

1(a) The calcium alginate is comparatively pure ($Ca^{2+}$ total assay)

(b) The level of soluble calcium (0.015%) on dry weight equates to 0.04% (on dry wt) of $CaCl_2$.

(c) The level of $Cl^-$ (in this $CaCl_2$) is equivalent to 0.012% as $Cl^-$ (on dry wt).

(d) This leaves 0.588% $Cl^-$ present as NaCl (the only other alternative) equivalent to 0.97% NaCl, which would equate to 0.38% Na, which agrees well with the found soluble sodium figure.

2(a) Papermaking reduces the level of extractable sodium down to minimal proportions (as would be expected from the large quantity of water used).

(b) Total sodium is also lowered from 0.61% to 0.06% by papermaking: the extractable sodium should be removed anyway (see (a) above), leaving (0.61–0.37%) 0.24% non-extractable sodium. It is likely this sodium is present attached to lengthy mannuronic acid chains.

(c) The argument in 1. above shows that no surface sodium alginate is present in the Ca33 for interfibre bonding, and 2(*a*) and 2(*b*) above demonstrates that insufficient is present during paprmaking to contribute effective surface fibre bonding. Certainly any sodium present in the paper is still trapped in the fibre 'core,' and spaced apart by many mannuronic acid repeat units and not available for surface bonding.

3. The volatile portion of the CA33 at 110° C/24 hours is not likely to be sodium alginate.

We claim:

1. A method of manufacturing alginate paper without the use or formation of an additional adhesive binder comprising the steps of forming a papermaking stock of raw fibrous water insoluble alginate material, said fibrous water insoluble alginate material being free of surface sodium alginate and being the only fibrous material used in said method, presenting said stock to the screen of the web-forming unit of a paper making machine arranged to form said paper and forming said paper on said machine, the pH value of said stock presented to said screen being at or below pH 7.0.

2. A method as defined in claim 1, wherein said fibrous alginate material is obtained by squirting an aqueous solution of water-soluble alginate into a solution of an inorganic salt whose cation will react with the alginate to produce a water-insoluble alginate.

3. A method as claimed in claim 1, in which the paper making machine is a Fourdrinier machine.

4. A method as claimed in claim 1, in which the alginate material comprises calcium alginate fibres.

5. A method as claimed in claim 4, in which minor proportion of a filler or solid diluent is incorporated in the paper.

6. A method as claimed in claim 4, in which there is added to the material of the paper after the screen a surface active agent.

7. A method as claimed in claim 6, in which the surface active agent is added by impregnation of the formed paper.

8. A method as claimed in claim 6, in which the surface active agent is a soap formed by reaction of an organic amino compound with a fatty acid, or an alkali salt of a long chain fatty acid.

9. A method as claimed in claim 6, in which the surface active agent is a sulphonated or sulphated organic compound or an inorganic derivative of such compound.

10. A method as claimed in claim 6, in which the surface active agent is a cationic surface active agent.

11. A method as claimed in claim 6, in which the surface active agent is a non-ionic organic compound.

12. A method as claimed in claim 4, in which colouring material is added to the material of the paper.

13. A method as claimed in claim 4, in which an aroma producing material is added to the material of the paper.

14. A method as claimed in claim 4, in which the paper is embossed, creped or crimped.

15. A method as claimed in claim 4, in which the paper is shredded.

16. An alginate paper consisting essentially of raw water insoluble alginate fibres which are held together to form the sheet material without the use or formation of an additional adhesive binder.

17. An alginate paper as defined in claim 16, wherein said alginate fibres are obtained by squirting an aqueous solution of water-soluble alginate into a solution of an inorganic salt, whose cation will react with the alginate to produce a water-insoluble alginate.

18. An alginate paper as defined in claim 16, wherein said alginate fibres comprise calcium alginate fibres.

* * * * *